United States Patent [19]

Siers

[11] 4,319,431

[45] Mar. 16, 1982

[54] ADJUSTABLE BOXCAR DEVICES

[76] Inventor: Gerald D. Siers, 8611 Wooded Glen, Louisville, Ky. 40208

[21] Appl. No.: 103,391

[22] Filed: Dec. 13, 1979

[51] Int. Cl.[3] ..... E05D 13/02

[52] U.S. Cl. ..... 49/426; 49/501

[58] Field of Search ..... 49/425, 426, 501, 505, 49/55, 472, 473, 474

[56] References Cited

U.S. PATENT DOCUMENTS

| | | | |
|---|---|---|---|
| 2,310,539 | 2/1943 | Nelson et al. | 49/55 X |
| 3,127,963 | 4/1964 | Beauchamp | 49/473 |
| 3,996,643 | 12/1976 | Steigerwald | 49/425 |

*Primary Examiner*—Kenneth Downey

*Attorney, Agent, or Firm*—Edward M. Steutermann

[57] ABSTRACT

The present invention discloses a new and useful door device for use in railroad box cars which is adjustable as to height and width including first tubular frame means and cooperative second tubular means where the first frame means is adapted to receive the second frame means, where the first frame is adjustable horizontally in relation to the second frame means, and roller assembly means of horizontally adjustable length and adapted to be received by the first and second frame means having first and second roller means where the vertical height of said first and second frame means are adjustable vertically in relation to the roller assembly means.

4 Claims, 7 Drawing Figures

FIG 5
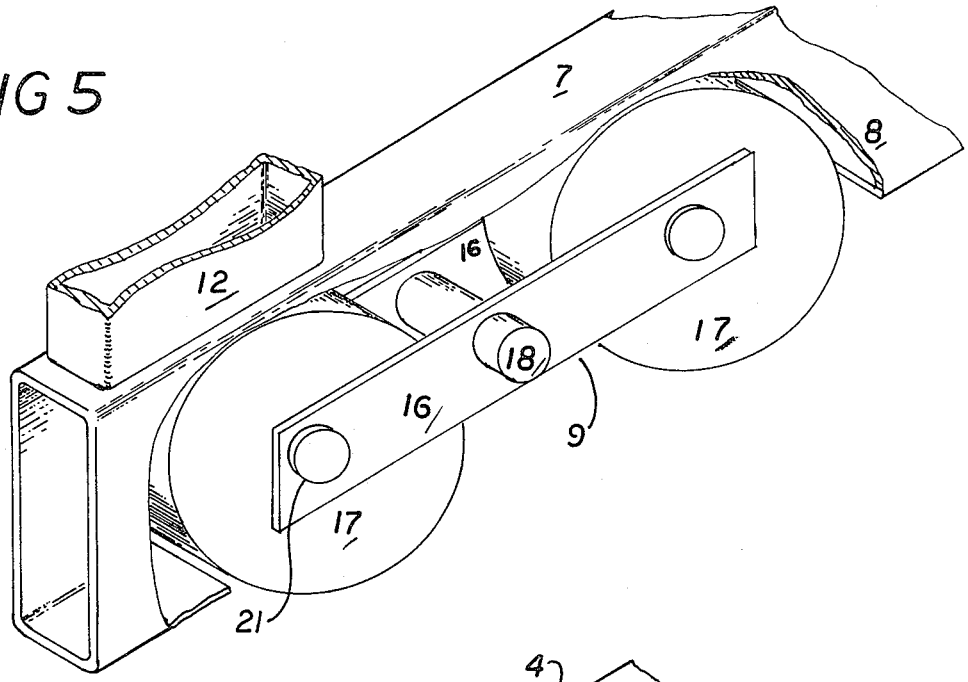
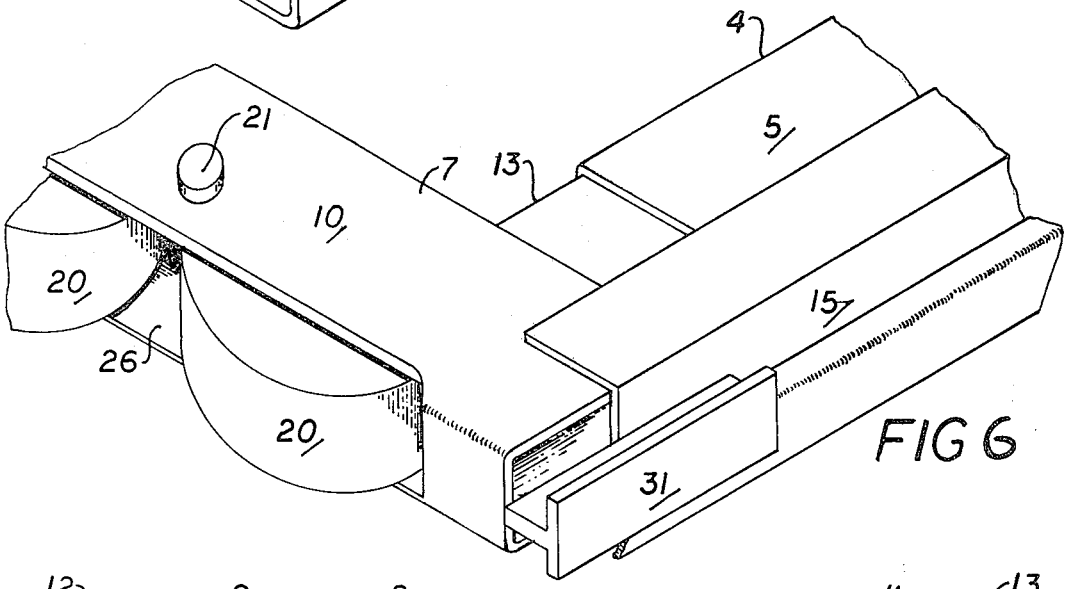
FIG 6
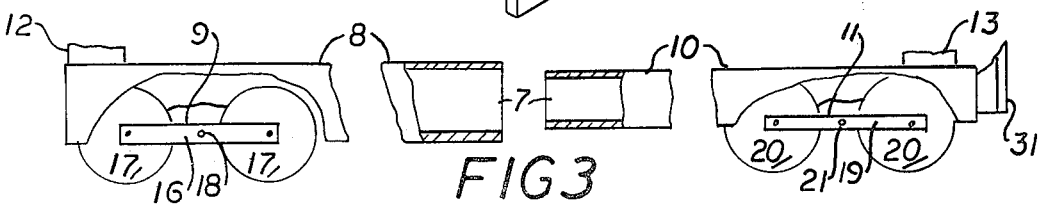
FIG 3
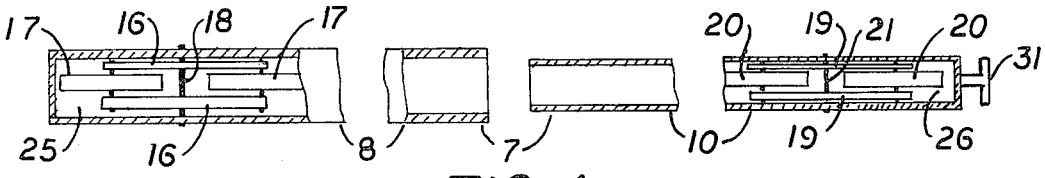
FIG 4

ADJUSTABLE BOXCAR DEVICES

BACKGROUND OF THE INVENTION

The present invention relates to replacement door devices for railway box cars, and more particularly to adjustable replacement door devices that are adjustable in both height and width.

It has been found that in the operation of railroad, boxcar doors are frequently damaged during the loading and unloading of materials from the boxcars. Because the railroad industry has no standard size boxcar doors, that is, every manufacturer produces cars having doors of different size, boxcar doors are varied in height and width. Replacement doors are too expensive for railroad companies to stock because of the many varied types of boxcar doors need.

Consequently a boxcar with a damaged door can be lost for a great period of time, in some cases longer than one year, while waiting for a replacement door to be found and/or fabricated. Not only does the railroad company lose money because the boxcar is idle and replacement doors are quite expensive, the railroad companies are also subject to be fined by the regulatory agencies for any railroad cars, including boxcars that are awaiting repairs, which are out of service for over one year.

Various means have been provided for improving boxcar door devices. Some such prior arrangements are illustrated in U.S. Pat. No. 3,513,783—Mayfield; U.S. Pat. No. 3,149,664—Keating; and U.S. Pat. No. 2,968,844—Formanski.

However none of these devices have arrangements that provide an inexpensive and time-saving arrangement to replace damaged boxcar doors.

One additional problem commonly encountered with boxcar doors is that the door tracks, on which the wheels attached to the bottom of the boxcar door roll as the door is opened and closed, often becoming uneven, and bumps or irregularities develop in the tracks with long periods of service. These irregularities and unevenness of the door tracks are caused by many factors including the weight of the forklifts, utilized in loading or unloading the boxcars, or other accidents such as mishandling material as it is being loaded or unloaded. If the irregularities are great enough, they can cause the boxcar door to bind so the door will not open or close properly, or not at all. Heretofore it has been necessary to straighten or replace the tracks on with the boxcar doors slide. Such repairs are time consuming, expensive and further result in loss of the use of the boxcar or boxcars being repaired.

SUMMARY OF THE INVENTION

The present invention provides a boxcar door arrangement to replace damaged boxcar doors where the boxcar can quickly be returned to rail service. Devices in accordance with the present invention are selectively adjustable in height and width over a wide range of demensions and can be designed to fit the vast majority of railroad boxcars since the railroad industry does not have a standard size boxcar door size.

Because the devices within the scope of the present invention are straightforward to design and inexpensive to fabricate, the railroad companies can stock the adjustable boxcar door and a boxcar deadline by a damaged door can be returned to service almost immediately, saving the railroad operator substantial amounts in the cost of repairs, loss of revenue from a boxcar being idle and any fines that may be levied by regulatory agencies from the cars being out of service for over a year.

In addition, by utilizing a pivotable roller means in accordance with the present invention's having wheels located in cooperative openings in the roller assembly means, it has been found that boxcar door binding because of the uneven door tracks or irregularities in the door tracks can be reduced significantly. More particularly the use of pivotable roller means in accordance with the present invention reduces the vertical displacement of the door as it passes over an uneven portion or bumps in the tracks where the boxcar door slides and as a result, significantly reduces the likelihood of the door binding on overhead guide tracks or at other locations. An example of an arrangement within the scope of the present invention is shown in the accompanying drawings and specification where it will be recognized that the arrangement shown is by way of example only and that other arrangements within the scope of the present invention will occur to those skilled in the art upon reading the disclosure provided herein.

BRIEF DESCRIPTION OF THE DRAWINGS

FIG. 3 is an enlarged front view of the roller assembly means shown in FIG. 1 with its right side fully extended beyond its left side.

FIG. 4 is a bottom view of the roller assembly means shown in FIG. 3.

FIG. 5 is an enlarged partially broken perspective view of the first roller means shown in FIG. 2.

FIG. 6 is an enlarged perspective view of the lower end stop means shown in FIG. 2.

Figure 1:
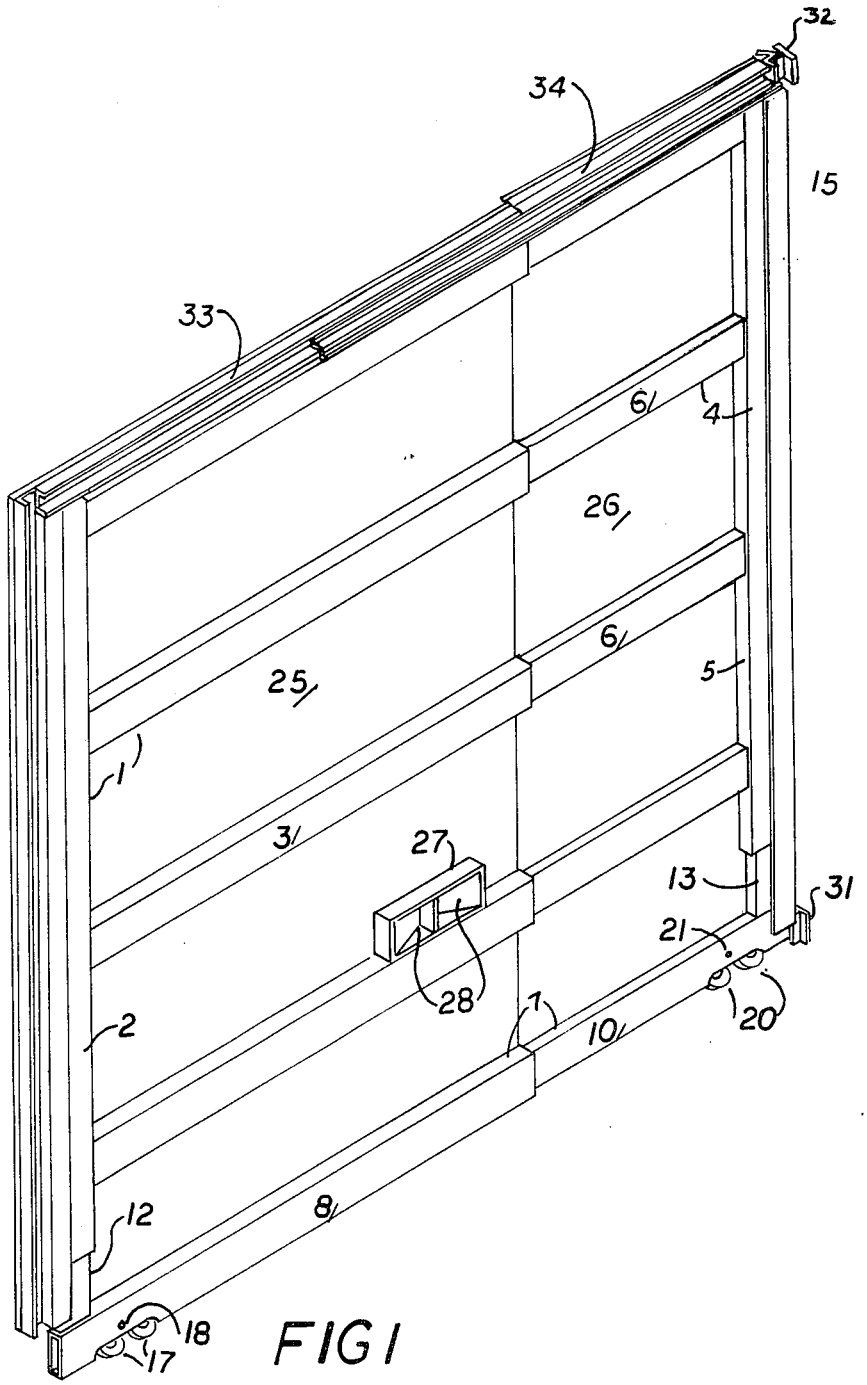
FIG. 1 shows a perspective view of an example of an adjustable boxcar door where said door is not extended either horizontally or vertically.
Figure 2:
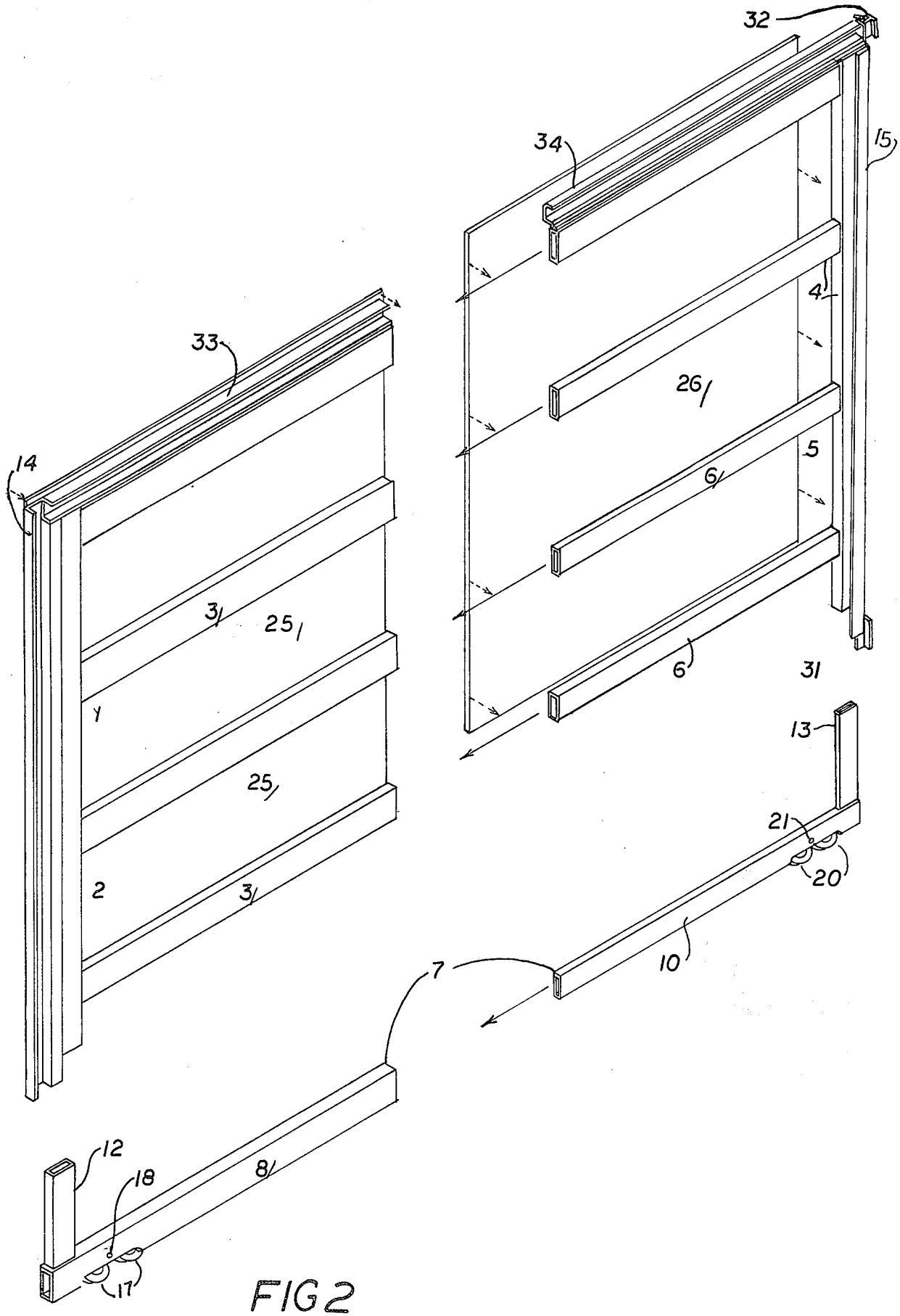
FIG. 2 shows an exploded perspective of the adjustable boxcar door shown in FIG. 1.

With respect to the illustration shown in FIG. 1 and FIG. 2, one embodiment of the adjustable boxcar door is shown having a rectangular configuration comprising a first frame means 1, second frame means 4, and roller assembly means 7.

The first frame means 1 includes a vertical elongated steel tube 2 having horizontal elongate tubes 3 of smaller dimensions extending horizontally from the vertical elongated tube 2. Within the scope of the present invention tubes 2 and 3, as well as other tubes discussed herein can be of any cross section but in the example shown the tubes are of rectangular cross section. A cooperative frame means 4 is provided and includes a vertically elongate tube 5 which can be of the same dimensions as tube 2 of the first frame means 1. Additionally, horizontally extending elongate tubes 6 are provided to advantageously extend from the second frame means 4 that are of smaller outer diameter than the internal diameter of elongate tubes 3 of first frame means 1 so that tubes 6 can be cooperatively received in tubes 3 of the first frame means 1 providing for horizontal adjustment in the adjustable boxcar door device. It should be understood that tubes 3 of first frame means 1 could be of smaller dimensions than tubes 6 of the second frame means 4 and therefore could slide into the tubes 6 of the second frame means 4. First frame means 1 and second frame means 4 are first assembled then a roller assembly 7 as described hereinafter is provided to define the bottom of the door assembly.

The roller assembly means 7 is comprised of a left side 8 having a first pivotal roller means 9 and a right side 10 adapted to be partially received in left side 8 and having a second pivotal roller means 11. The outer diameter of right side 10 is smaller than the diameter of the left side 8 and therefore slides into and out of the left side 8 to provide for horizontal length adjustment of roller assembly means 7. Similarly, the left side 8 could be of smaller diameter than the right side 10 and adapted to slide into and out of the right side 10. As the second frame 4 is adjusted in respect to the first frame means 1, the right side 10 cooperatively slides out of the left side 8 and adjusts the roller assembly means 7 accordingly.

The left side 8 of the roller assembly means 7 is further provided with a first vertical extending steel tube 12 adjacent one end which cooperatively fits into the vertical elongate tube 2 of the first frame 1. Similarly, the right side 10 of the roller assembly 7 is provided with a second vertical extending steel tube 13 adjacent the one end which is cooperatively received in the vertical elongate tube 5 of the second frame 4. The first and second vertical extending steel tubes 12 and 13 provide for vertical adjustment of the left frame means 1 and the right frame means 4 allowing the selection of the proper height of the boxcar door to be fabricated.

As is known in the art, a front fire seal 14 can be attached to the first frame 1 and a rear fire seal 15 can be attached to the second frame 4.

FIGS. 1 and 2 illustrate one configuration of a front fire seal 14 and a rear fire seal 15.

FIG. 2 shows an exploded view of the adjustable boxcar door shown in FIG. 1 with the second frame 4 fully extended horizontally from the first frame 1, the left side 8 and the right side 10 of the roller assembly 7 fully extended horizontally from each other and the first and second frame, 1 and 4, fully extended vertically from the cooperative roller assembly 7.

As shown in FIGS. 3 and 4, the roller assembly 7 is comprised of a left side 8 and right side 10 that cooperatively slides into the left side 8 for horizontal adjustment.

A first pivotal roller means 9 is located in a first opening 25 in the left side of the roller assembly means 7 and is comprised of yoke assembly 16 having two wheels 17 with a pivot means 18 located between the two wheels 17 where the pivot means 18 attaches the yoke assembly 16 to the left side 8 of the roller assembly means 7. Similarly a second pivotal roller means 11 is located at a second opening 26 in the right side 10 of the roller assembly means 7 having a yoke assembly 19, two wheels 20 and a pivot means 21 where the pivot means 21 attaches the yoke assembly 19 to the right side 10. The second pivotal roller means 11 is advantageously positioned on the right side 10 so that the bottom of the wheels 20 lie in the same horizontal plane as do the bottom of the wheels 17 of the first pivotal roller means. The first and second pivotal roller means 9 and 11 provide for the adjustable boxcar door device to slide over any irregularities or bumps in the door tracks (not shown) eliminating vertical displacement of the boxcar door, thus preventing the door from binding and saving the expense of replacing door tracks that have been damaged during loading and unloading of the boxcar. The first pivotal roller means 9 is shown in more detail in FIG. 5.

As shown in FIGS. 1 and 2 the door device is provided with a first end stop 31 and a second end stop 32 to protect the door when it is opened and reaches the end of the slide tracks (see FIG. 7) provided on the boxcar door. The first end stop 31 is welded to the extreme lower portion of the rear fire seal 15 and the right edge of the roller assembly 10. The second end stop is welded to the extreme top portion of the rear fire seal 15. The first end stop 31 is shown in detail in FIG. 6.

In addition, as shown in FIGS. 1 and 2, a first and second cover panel, 25 and 26, made up of a steel sheet approximately 1/16th inch thick, rectangular in shape and large enough to cover the first frame 1, second frame 4, and roller assembly means 7 when the adjustable boxcar door is fully extended horizontally and vertically, are provided to cover the inside of the adjustable boxcar door device. The first cover panel 25 is welded to the rear portion of the left frame means and entirely covers it. Any excess steel that is not needed can be cut off once the height of the door opening is determined. The second cover panel 26 is welded to the second frame means after the second frame means is extended to the desired horizontal position and has been welded in place and any excess steel along the bottom edge may be cut off once the height of the door opening is determined.

In addition, as shown in FIGS. 1 and 2, the first frame 1 can be provided with a U-shaped first top track 33 that is welded to the top of the first frame 1 and a cooperative U-shaped second top track 34 of slightly smaller dimensions than the first top track 33 where said second top track 34 cooperatively slides into the first top track 33. The second top track 34 is uniquely designed with an L-shaped member 35 that provides for the second top track 34 to cooperatively slide into the first top track 33 and further provides for the second top track 34 to be welded to the second frame 4 and the first frame 1 when the boxcar door device is adjusted to the proper width.

Within the scope of the present invention the second top track is initially only welded to the second frame 4 at the end opposite the first frame means 1 to provide for the second top track 34 to slide over the first frame 1, as shown in FIG. 1, when the boxcar door is initially assembled and before the first frame 1, second frame 4 and roller assembly 7 are welded together by means known in the art. Another embodiment of the present invention but not shown in the drawings provides an elongate opening in the top of the first frame means 1 to allow the second top frame 34 to be welded along its entire length to the second frame 2. The elongate opening in the first frame 1 provides for the second top track 34 to cooperatively slide into the first top track 33 as the second frame 4 is cooperatively moved into the first frame 1.

The first and second top track, 33 and 34 provided can be utilized on any boxcar used in the rail industry and prevents the adjustable box car device from falling off the boxcar at the top when the adjustable boxcar door device is placed on the boxcar by catching the water channel 36 which is found on all boxcars utilized in the rail industry. Although the water channel 36 catches the top tracks of the adjustable boxcar door and prevents the door from falling off the boxcar, it allows the adjustable boxcar device to slide back and forth along the length of the boxcar.

To install the adjustable boxcar door device the damaged door is taken off the boxcar by removing the lower door stops (not shown). The damaged door is pulled outward away from the boxcar and then lowered to the ground. The opening in the boxcar is measured and the adjustable boxcar door device within the scope of the present invention is adjusted to the proper width and height by horizontally adjusting the first and second frame, 1 and 4, and the left side 8 and right side 10 of the roller assembly 7. The door device is welded at all points where the first frame 1 and second frame 4 meet, and where the left side 8 and right side 10 of the roller assembly 7 meet.

The proper vertical adjustments are then made by adjusting the first and second frame, 1 and 4, in relation to the roller assembly 7.

Figure 7:
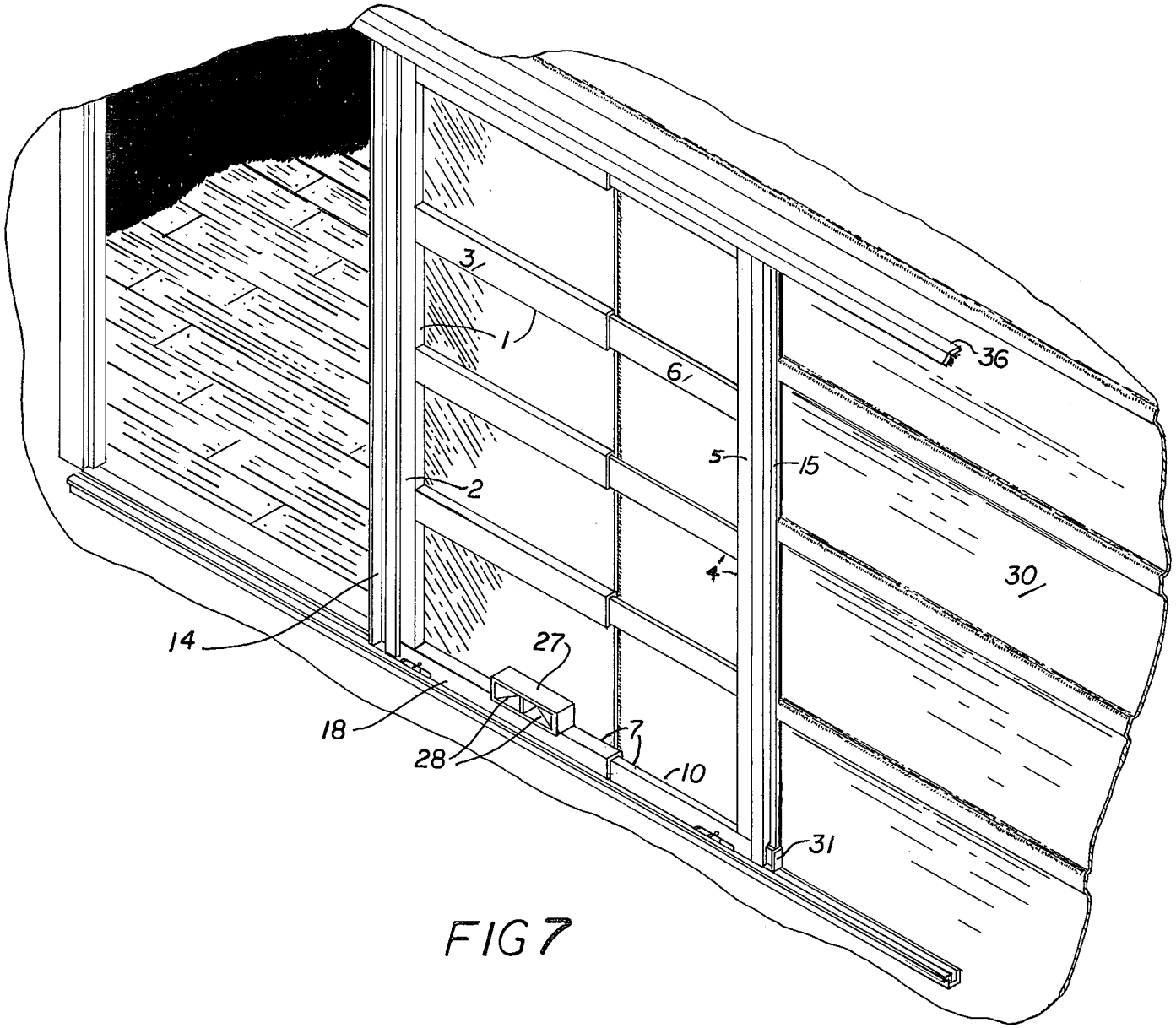
FIG. 7 is a perspective view of the boxcar door as it appears on a boxcar.

Additionally a push pocket means 27 shown in FIGS. 1 and 7, can be advantageously positioned and welded on a horizontal elongate tube 3 of the first frame means 1 or on the roller assembly means 7 to provide a means for a forklift to open or close the adjustable boxcar door device. The push pocket means 27 is the same depth as the horizontal elongated steel tube 3 and fits flush against the first cover panel 25. The sides 28 of the push pocket means 27 are angled to the rear of the push pocket means 27 to assist the forklift operator in utilizing the forks of the forklift to open or close the adjustable boxcar device.

After the adjustable door device is securely welded together, the door device is placed on the boxcar so the wheels 17 and 20, will slide properly in the lower tracks and the lower door stops (not shown) are placed back on the boxcar to hold the door device securely in place.

As illustrated in FIG. 7, the boxcar door is shown as it would appear after being installed on a boxcar 30, showing the first frame 1, second frame 4, and roller assembly means 7 with the cover panels 25 and 26 welded on the inside of the boxcar door device.

The invention claimed is:

1. An adjustable door device for use in railroad boxcars which is adjustable as to height and width and includes first and second frame means each including a vertical tubular member having a plurality of horizontal tubular members extending therefrom, wherein the horizontal tubular members of the first frame means telescopingly receives the horizontal tubular members of the second frame means so that the horizontal length of the assembled first and second frame means is adjustable; roller assembly means including horizontal first and second tubular members wherein the first tubular member telescopingly receives the second tubular member for horizontal adjustment of said roller assembly means, roller means within each of the first and second tubular members comprising yoke means centrally pivoted within the first and second tubular members adjacent the ends thereof and wheels rotatably mounted at each end of the yokes, said rollers extending through openings in the bottoms of said tubular members; upstanding legs on the tops of the first and second tubular members of the roller assembly means adjacent the ends thereof which are received in the vertical tubular members of the first and second frame members wherein the vertical height of said first and second frame means is vertically adjustable with respect to the roller assembly means; and wherein the said first and second frame means includes telescoping top track means at the upper edge thereof.

2. The invention of claim 1 where said adjustable door device includes front fire seal means.

3. The invention of claim 1 where said adjustable door device includes rear fire seal means.

4. The invention of claim 1 where said adjustable door device includes push pocket means to receive the forks of a forklift to open or close said adjustable door device.

* * * * *